US006015235A

United States Patent [19]

Kraimer et al.

[11] Patent Number: 6,015,235

[45] Date of Patent: Jan. 18, 2000

[54] PUNCTURE-RESISTANT BARRIER POUCH

[75] Inventors: Amy L. Kraimer, Omro; Gregory Pockat, Ripon, both of Wis.; David Wohlert, Midlothian, Va.

[73] Assignee: Curwood, Inc., Oshkosh, Wis.

[21] Appl. No.: 09/030,684

[22] Filed: Feb. 25, 1998

Related U.S. Application Data

[60] Provisional application No. 60/040,077, Mar. 7, 1997.

[51] Int. Cl.[7] ..... B65D 30/02

[52] U.S. Cl. ..... 383/109; 383/94; 426/129

[58] Field of Search ..... 383/119, 93, 94; 426/129

[56] References Cited

U.S. PATENT DOCUMENTS

| | | | |
|---|---|---|---|
| 3,249,286 | 5/1966 | Palmer | 383/104 |
| 3,650,775 | 3/1972 | Simon et al. . | |
| 4,136,205 | 1/1979 | Quattlebaum . | |
| 4,239,111 | 12/1980 | Conant et al. . | |
| 4,267,960 | 5/1981 | Lind et al. . | |
| 4,481,669 | 11/1984 | Pezzana et al. | 383/94 |
| 4,755,403 | 7/1988 | Ferguson . | |
| 4,765,857 | 8/1988 | Ferguson | 383/119 |
| 4,863,769 | 9/1989 | Lustig et al. . | |
| 4,863,784 | 9/1989 | Lustig et al. . | |
| 4,976,898 | 12/1990 | Lustig et al. . | |
| 4,988,465 | 1/1991 | Lustig et al. . | |
| 5,020,922 | 6/1991 | Schirmer . | |
| 5,059,481 | 10/1991 | Lustig et al. . | |
| 5,256,351 | 10/1993 | Lustig et al. . | |
| 5,256,428 | 10/1993 | Lustig et al. . | |
| 5,302,402 | 4/1994 | Dudenhoeffer et al. . | |
| 5,376,394 | 12/1994 | Dudenhoeffer et al. . | |
| 5,501,525 | 3/1996 | Cox et al. . | |
| 5,545,419 | 8/1996 | Brady et al. | 383/114 |

*Primary Examiner*—Stephen P. Garbe
*Attorney, Agent, or Firm*—Lee, Mann, Smith, McWilliams, Sweeney & Ohlson

[57] ABSTRACT

A puncture resistant barrier pouch for the packaging of bone-in-meat and other products. The pouch includes a body portion having a chamber and an open end, and a neck portion that extends outwardly from the open end of the body portion. The neck portion includes an open mouth and a passageway that extends from the mouth of the neck portion to the chamber of the body portion. The body portion includes walls that are formed by relatively thick film material and the neck portion includes walls that are formed by relatively thin film material. The product to be packaged is placed in the chamber of the body portion such that the relatively thick walls of the body portion enclose the product while resisting tearing or puncturing by the product. The relatively thin walls of the neck portion allow the walls of the neck portion to be easily heat sealed together, thereby hermetically sealing closed the passage to the chamber and hermetically sealing the product within the chamber of the body portion.

36 Claims, 2 Drawing Sheets

FIG.4
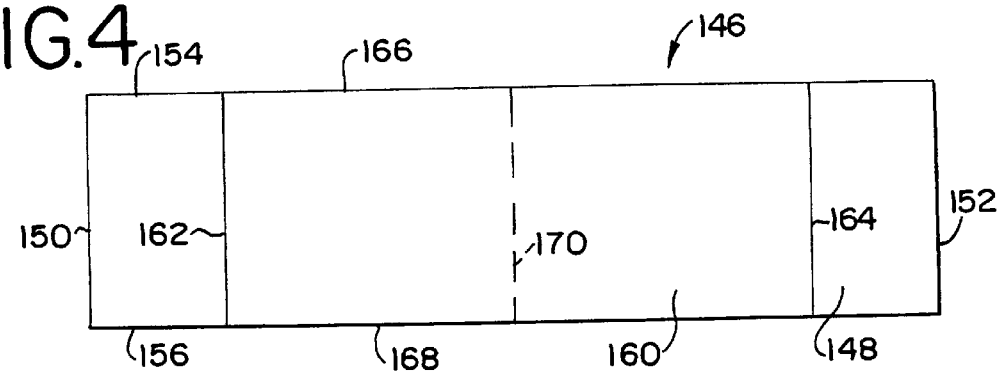
FIG.5
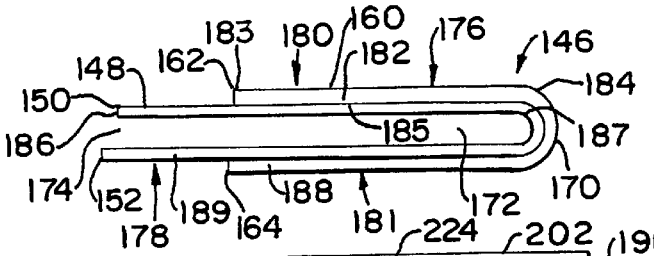
FIG.6
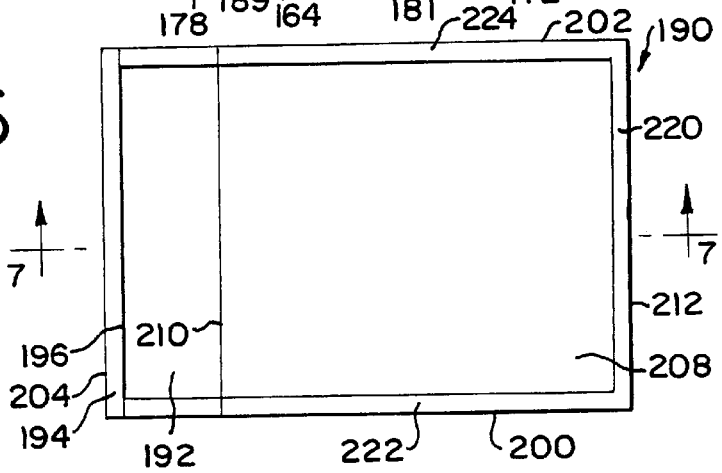
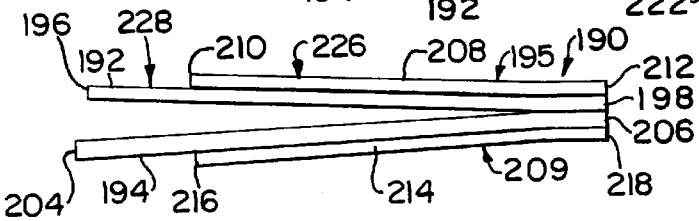
FIG.7
FIG.8
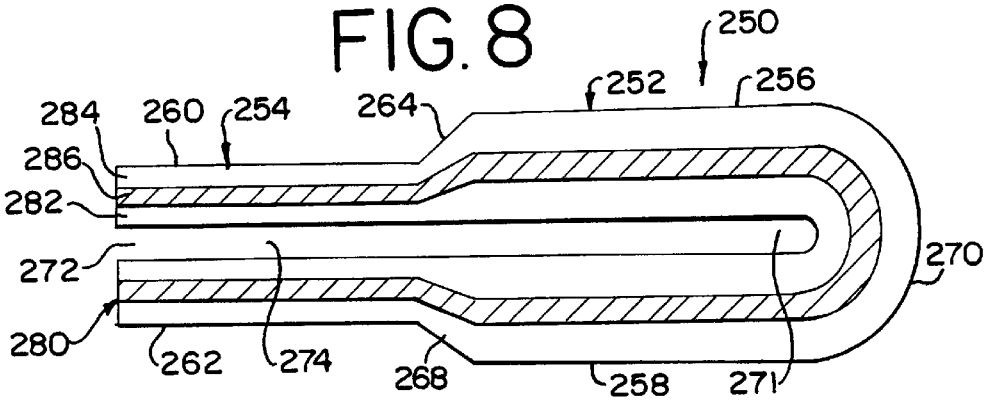

PUNCTURE-RESISTANT BARRIER POUCH

RELATED APPLICATIONS

This application claims the benefit of U.S. Provisional Application Ser. No. 60/040,077, filed Mar. 7, 1997.

BACKGROUND OF THE INVENTION

The present invention is directed to a puncture-resistant barrier pouch for the packaging of bone-in meat or other products having projecting parts or having parts that may be sharp, and in particular to a pouch having a body portion formed from a film that is relatively thick and that forms a product receiving chamber and having a neck portion that extends from an open end of the body portion that is formed from a heat sealable film that is relatively thin.

Bone-in cuts of meat often include sharp bones that protrude outwardly from the meat. When the bone-in meat is packaged the protruding bones often puncture or tear the packaging material. Two methods for vacuum packing bone-in meat have previously been used. The first method involves the use of a puncture-resistant material, such as a waxed cloth, which is placed over the bones protruding from the meat. The meat is then placed into a bag which is then vacuum sealed. This method is undesirable because of the potential for the cloth to move from its original position during loading of the meat into the bag, thereby leaving the protruding bone exposed. This method of packaging also provides undesirably low packaging rates because the puncture-resistant cloth must be hand placed over the bones.

The second previously used packaging method involves the use of a seamless heat sealable barrier bag. A patch of material which is more puncture-resistant than the barrier bag is adhered to the outside of the barrier bag. The neck of the barrier bag is left unprotected for the purpose of heat sealing the package after the bone-in meat is inserted. In this method the puncture-resistant patch is located on the outside of the barrier bag. The barrier of the package is compromised when a bone punctures the barrier bag. Even when the protective patch prevents a bone from piercing the entire wall of the package, it does not prevent the bone from puncturing the barrier bag. It is not economically feasible to adhere the puncture-resistant patch to the inside of the seamless barrier bag. In addition, the puncture-resistant patch does not completely cover the sides and the bottom edge of the barrier bag. This leads to a high number of package failures due to bone punctures in these unprotected areas. The puncture-resistant patch is opaque, which is undesirable as clarity of the package is important to meat packers and their customers. This type of existing pouch is also expensive to manufacture and use because it is produced using seamless bags made of heat shrinkable material.

Many users of these types of pouches utilize sealing equipment that uses impulse type seals to seal the opening of the pouch. An impulse seal relies on a quick burst of electricity to heat the film and seal the pouch. Many pouches are wrinkled in the seal area after being filled with the product. Thick films having wrinkles are extremely difficult to seal completely closed due to the limited ability of impulse seals to transfer heat through the films. A complete seal is important because of the vacuum package to be utilized.

SUMMARY OF THE INVENTION

The present invention provides a pouch that includes a body portion having a chamber and an open end, and a neck portion that extends outwardly from the open end of the body portion. The neck portion includes an open mouth and a passageway that extends from the mouth to the chamber of the body portion. The body portion includes walls that are formed by relatively thick non-heat-shrinkable film material and the neck portion includes walls that are formed by relatively thin non-heat-shrinkable film material. A product to be packaged is placed within the chamber of the body portion such that the relatively thick walls of the body portion enclose the product while resisting tearing or puncturing by the product. The relatively thin walls of the neck portion allow the walls of the neck portion to be easily heated sealed together, thereby hermetically sealing closed the passage to the chamber and hermetically sealing the product within the chamber of the body portion.

BRIEF DESCRIPTION OF THE DRAWING FIGURES

FIG. 4 is a top plan view showing a sheet of film that forms the body portion of an alternate embodiment of the pouch adhesively laminated to a sheet of film that forms the neck portion of the pouch.

FIG. 5 is a cross-sectional view of the modified embodiment of the pouch formed from the sheets of film shown in FIG. 4.

FIG. 6 is a top plan view of a further modified embodiment of the pouch.

FIG. 7 is a cross-sectional view of the pouch taken along lines 7—7 of FIG. 6.

FIG. 8 is a cross-sectional view of another embodiment of the pouch.

DETAILED DESCRIPTION OF THE PREFERRED EMBODIMENTS

Figure 1:
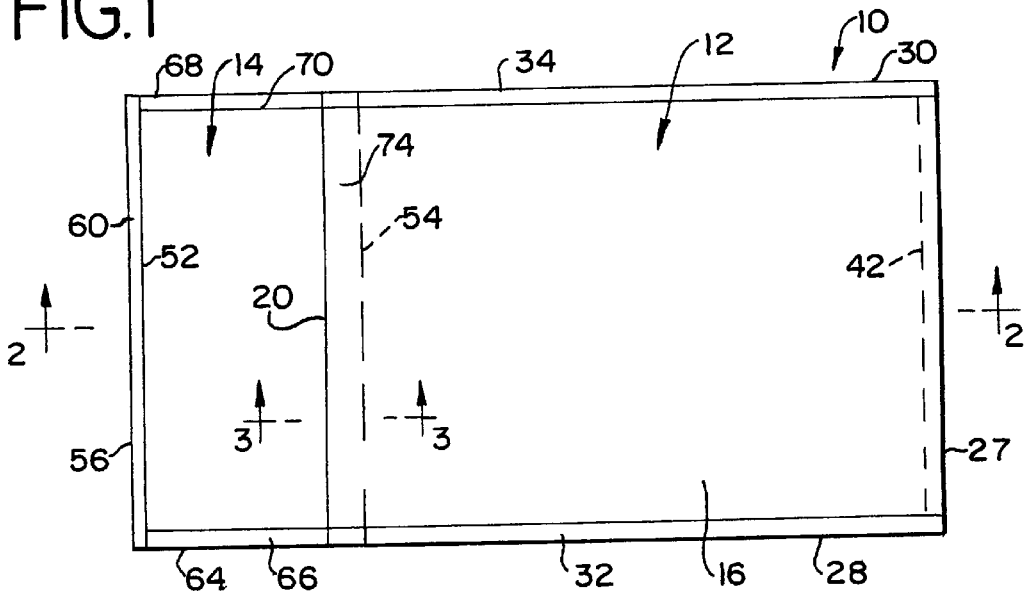
FIG. 1 is a top plan vie w of a puncture-resistant barrier pouch of the present invention.
Figure 2:
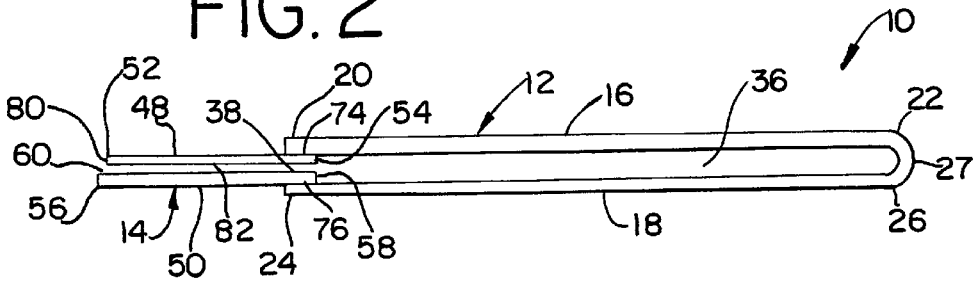
Figure 2 is a cross-sectional view of the pouch taken along lines 2—2 of FIG. 1.

One embodiment of the puncture-resistant barrier pouch 10 of the present invention is shown in FIG. 1. The pouch 10 includes a puncture-resistant body portion 12 and a heat sealable neck portion 14. The body portion 12 includes a generally rectangular wall 16 that overlies a second generally rectangular wall 18. The first wall 16 extends between a first end 20 and an opposing second end 22. The second wall 18 extends between a first end 24 and a second end 26. As shown in FIG. 2, the body portion 12 is formed by a single sheet of film material that is folded over upon itself to form the first wall 16 and the second wall 18 and such that the second end 22 of the first wall 16 is connected to the second end 26 of the second wall 18 by a fold 27. Alternatively, the first wall 16 and the second wall 18 can be formed from separate sheets of film with one end of the first wall 16 connected to the second wall 18 by a heat seal 42. The first wall 16 and the second wall 18 each include first side edges 28 and spaced apart and opposing second side edges 30. The respective first side edges 28 of the first wall 16 and the second wall 18 are hermetically heat sealed to one another by a heat seal 32. The respective second side edges 30 of the first and second walls 16 and 18 are hermetically heat sealed to one another by a heat seal 34. The heat seals 32 and 34 and the closed end 27 hermetically seal the body portion 12 along three sides thereby forming a chamber 36 for the receipt of bone-in meat or other products therein. The first end 20 of the first wall 16 and the first end 24 of the second wall 18 forms an open mouth 38 that provides access to the chamber 36 for inserting product therein.

The body portion 12 of the pouch 10 as shown in FIG. 2 is formed from a single sheet of film material that is folded over upon itself. However, alternatively, the body portion 12 can be formed from a first sheet of film material that forms the first wall 16 and a second separate sheet of film material that forms the second wall 18. The two sheets of film material can be hermetically heat sealed to one another along their respective side edges, and the bottom edges of the two sheets can be hermetically sealed together by a heat seal 42 as shown in dashed lines in FIG. 1 to seal three sides of the body portion.

The neck portion 14 of the pouch 10 includes a first wall 48 formed by a first sheet of film material and a second wall 50 formed by a second sheet of film material. The first wall 48 extends between a first end 52 and a second end 54. The second wall 50 extends between a first end 56 and a second end 58. The first end 56 of the second wall 50 preferably extends beyond the first end 52 of the first wall 48 to form a lip 60. If desired, the lip 60 can be eliminated. Respective first side edges 64 of the first wall 48 and second wall 50 are hermetically heat sealed to one another by a heat seal 66. Respective second side edges 68 of the first wall 48 and second wall 50 are hermetically heat sealed to one another by a heat seal 70. The heat seals 32 and 66 may be formed as one continuous heat seal and the heat seals 34 and 70 may also be formed as one continuous heat seal. Each of the walls 16 and 18 of the body portion 12 have a thickness that is greater than the thickness of the walls 48 and 50 of the neck portion 14.

The second ends 54 and 58 of the neck portion 14 are inserted into the mouth 38 of the body portion 12 such that the first wall 16 of the body portion 12 overlaps with the first wall 48 of the neck portion 14 and such that the second wall 18 of the body portion 12 overlaps with the second wall 50 of the neck portion 14. The walls overlap one another by between one-half inch and two inches, and preferably by about one inch depending upon the overall size of the bag. The second end 54 of the first wall 48 of the neck portion 14 is hermetically heat sealed to the first end 20 of the first wall 16 of the body portion 12 by a heat seal 74 that extends between the heat seals 32 and 34. The second end 58 of the second wall 50 of the neck portion 14 is hermetically heat sealed to the first end 24 of the second wall 18 of the body portion 12 by a heat seal 76 that also extends between the beat seals 32 and 34.

The neck portion 14 includes a mouth 80 that is formed between the first end 52 and first end 56 of the first and second walls 48 and 50. The neck portion 14 also includes a passage 82 formed between the first wall 48 and second wall 50 that extends between the mouth 80 and chamber 36. The length of the neck portion 14 between the ends 20 and 24 of the body portion 12 and the ends 52 and 56 of the neck portion 14 is preferably shorter than the length of the body portion 12 between the closed end 27 and the ends 20 and 24 of the body portion 12.

Figure 3:
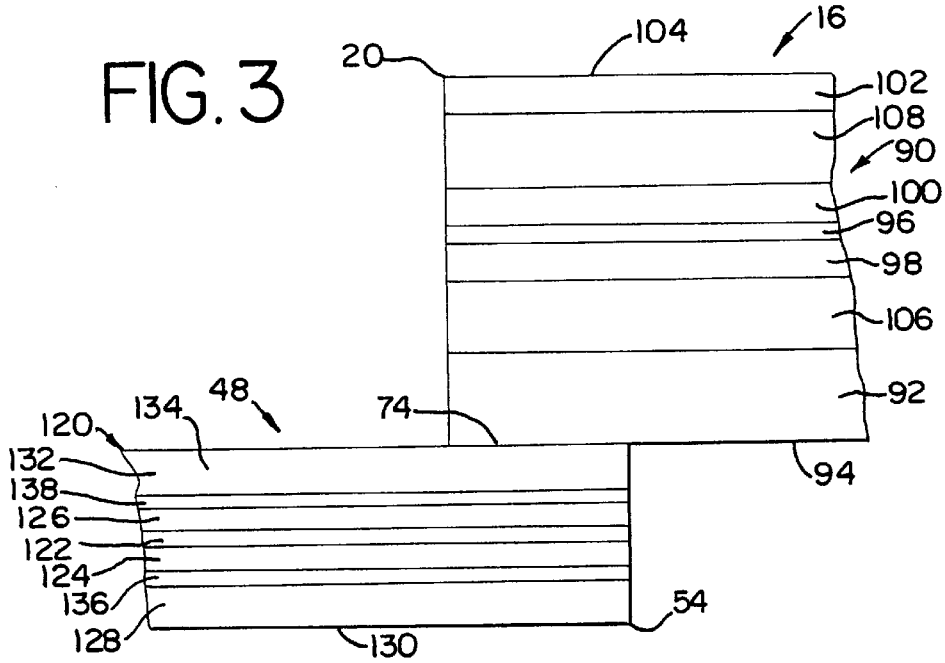
FIG. 3 is a partial cross-sectional view of the pouch taken along lines 3—3 of FIG. 1 showing the connection of one wall of the neck portion to one wall of the body portion of the pouch.

The first and second walls 16 and 18 of the body portion 12 are each formed from a multilayer puncture-resistant film 90 that is preferably clear. In a preferred embodiment the film 90 is a non-heat-shrinkable film. Heat shrinkable films are not necessary for packages of this type. As best shown in FIG. 3, the puncture-resistant film 90 includes an inner heat sealable layer 92 having an inner surface 94. The inner heat sealant layer 92 preferably comprises a heat sealable polymeric material such as very low density polyethylene (VLDPE), ultra low density polyethylene (ULDPE), or polyolefin resins made with metallocene single-site catalysts, especially very low density materials. Ethylene vinyl acetate (EVA) copolymers are also suitable materials for forming the inner heat sealable layer 92. The inner heat sealable layer 92 is preferably relatively thick in relation to the other layers of the film 90 and preferably forms about twenty-four percent of the total thickness of the film 90. In addition to providing heat sealing properties, the heat sealable layer 92 provides toughness and puncture resistance for the overall film structure 90. As used herein, a non-heat-shrinkable film includes a film that may shrink a minimal amount under the application of heat such as up to about five percent, whereas heat shrinkable film as known to those of ordinary skill in the art will shrink an amount that is substantially more. Non-heat-shrinkable films are preferred as heat-shrinkable films pull out of voids in the meat product and away from the meat surface in a vacuum packaged product.

As shown in FIG. 3 the puncture-resistant film 90 also includes a core layer 96 that is formed from an oxygen barrier material such as ethylene vinyl alcohol copolymer (EVOH) to provide increased shelf life of the product that is packaged in the pouch 10. The core layer 96 preferably forms about six percent of the total thickness of the film 90. An intermediate layer 98 and an intermediate layer 100 are respectively bonded to opposite surfaces of the core layer 96. The intermediate layers 98 and 100 preferably comprise a polyamide, such as nylon 6/66. Each of the intermediate layers 98 and 100 preferably has a thickness that comprises approximately nine percent of the total thickness of the film 90. The intermediate layers 98 and 100 provide heat resistance and toughness to the film 90.

The puncture-resistant film 90 also includes an outer layer 102 having an outer surface 104. The outer layer 102 preferably comprises a polyamide such as nylon 6/66 or polyolefin resins made with metallocene single-site catalysts, especially very low density materials. The outer layer 102 forms the outer surface of the body portion 12. The outer layer 102 has a thickness that comprises approximately twelve percent of the total thickness of the film 90. The outer layer 102 provides heat and puncture resistance to the film 90. The inner heat sealant layer 92 and the outer layer 102 preferably contain minor amounts of additives such as slip and antiblock agents which enhance the handling of the body portion 12 as are well known in the art.

A relatively thick adhesive tie layer 106 bonds the inner heat sealable layer 92 to the intermediate layer 98. A relatively thick adhesive tie layer 108 bonds the outer layer 102 to the intermediate layer 100. Each of the adhesive tie layers 106 and 108 are preferably formed from an anhydride modified polyolefin, and preferably ultra low density polyethylene (ULDPE). Other polyolefin bases, such as linear low density polyethylene (LLDPE), may also be used for the adhesive tie layers 106 and 108. Each of the adhesive tie layers 106 and 108 have a thickness that comprises approximately twenty percent of the total thickness of the film 90. The adhesive tie layers 106 and 108 provide moisture protection for the core layer 96 and puncture resistance to the overall film 90. The inner heat sealant layer 92 also provides moisture protection for the core layer 96.

The multilayer puncture-resistant film 90 is preferably produced by conventional coextrusion techniques followed by quenching. As used to form the walls 16 and 18 of the pouch 10, the overall thickness of the film 90 is preferably between approximately three mils and approximately twelve mils, and is preferably approximately seven mils thick In general, films of less than about three mils thickness will not provide sufficient toughness, and films of greater than twelve mils thickness will be difficult to handle because of stiffness. Although the preferred construction of the film 90 has been described, various other constructions of the film 90 can be utilized as will be evident to a person skilled in the art, including a single layer film.

The preferred thicknesses of the various layers that comprise the film 90 may vary. The inner heat sealable layer 92 may vary in thickness such that it forms between approximately twenty-four percent and approximately fifty percent of the total thickness of the film 90. The tie layer 106 may vary in thickness such that it comprises between approximately five percent and approximately twenty percent of the total thickness of the film 90. The thickness of the intermediate layer 98 may vary such that it comprises between approximately five percent and approximately fifteen percent of the total thickness of the film 90. The thickness of the core layer 96 may vary between approximately five percent and approximately ten percent of the total thickness of the film 90. The thickness of the intermediate layer 100 may vary between approximately five percent and approximately fifteen percent of the total thickness of the film 90. The thickness of the tie layer 108 may vary between approximately five percent and approximately twenty percent of the total thickness of the film 90. The thickness of the outer layer 102 may vary between approximately ten percent and approximately twenty percent of the thickness of the film 90.

In one example, a coextruded multilayer barrier film 90 was produced having a total thickness of seven mils. The film 90 included an inner heat sealable layer 92 of polyolefin having a thickness comprising twenty-five percent of the total thickness of the film. The tie layer 106 had a thickness that formed twenty percent of the total thickness of the film 90. The intermediate layer 98 was formed of nylon and had a thickness comprising nine percent of the total thickness of the film 90. The core layer 96 was formed from EVOH and had a thickness that comprised five percent of the total thickness of the film 90. The intermediate layer 100 was formed of nylon and had a thickness that comprised nine percent of the total thickness of the film 90. The tie layer 108 had a thickness that comprised twenty percent of the total thickness of the film 90. The outer layer 102 was formed of nylon and had a thickness that comprised twelve percent of the total thickness of the film 90. The nylon that formed the layers 98, 100 and 102 was BASF C35 nylon 6/66. The tie layers 106 and 108 were formed from anhydride modified LLDPE. The core layer 96 of EVOH was EVAL H101 from EVALCA. The polyolefin inner heat sealable layer 92 was formed from Attane 4201 from Dow Chemical.

The first wall 48 and the second wall 50 of the neck portion 14 are each preferably formed from a multilayer puncture-resistant heat sealable film 120 that is preferably clear. In a preferred embodiment the film 120 is a non-heat-shrinkable film. The heat sealable film 120, as best shown in FIG. 3, includes a core layer 122 formed from an oxygen barrier material such as ethylene vinyl alcohol (EVOH) copolymer that is designed to provide increased shelf life to the packaged product. The core layer 122 has a thickness that preferably forms about ten percent of the total thickness of the film 120. Intermediate layers 124 and 126 are respectively bonded to opposing surfaces of the core layer 122. The intermediate layers 124 and 126 are formed from a polyamide and preferably nylon 6/66. Each intermediate layers 124 and 126 each has a thickness that comprises approximately twelve and one-half percent of the total thickness of the film 120. The intermediate layers 124 and 126 provide heat resistance and puncture resistance to the film 120.

The heat sealable film 120 includes an inner heat sealable layer 128 having an inner surface 130 and an outer heat sealable layer 132 having an outer surface 134. The inner and outer heat sealable layers 128 and 132 are formed from a heat sealable polymeric material such as an ethylene alpha-olefin copolymer, and preferably very low density polyethylene (VLDPE), ultra low density polyethylene (ULDPE), or polyolefin resins made with metallocene single-site catalysts, especially very low density materials. The inner and outer heat sealable layers 128 and 132 may also be formed with linear low density polyethylene (LLDPE) and blends of these materials. The inner and outer heat sealable layers 128 and 132 each have a thickness that respectively comprises approximately twenty-four and one-half percent of the total thickness of the film 120. The inner and outer heat sealable layers 128 and 132 may have different thicknesses relative to one another and may be formed from different materials relative to one another. The inner and outer heat sealable layers 128 and 132 provide moisture protection for the core layer 122 and provide toughness to the overall film structure 120. The inner and outer heat sealant layers 128 and 132 preferably contain minor amounts of additives such as slip and antiblock agents which enhance the handling of the neck portion 14 as are well known in the art.

Relatively thin adhesive tie layers 136 and 138 respectively bond the intermediate layer 124 to the inner heat sealable layer 128 and bond the intermediate layer 126 to the outer heat sealable layer 132. The tie layers 136 and 138 each have a thickness of approximately seven percent of the total thickness of the film 120. The tie layers 136 and 138 are formed from a polyolefin and preferably a linear low density polyethylene which is chemically modified to enhance its adhesion properties. Other polyolefin based polymeric adhesives are also suitable for use as the tie layers 136 and 138.

The multilayer film 120 is preferably produced by conventional coextrusion techniques. As used to form the walls 48 and 50 of the neck portion 14 of the pouch 10, the overall thickness of the film 120 is preferably between approximately two mils and approximately five mils and is preferably approximately three and one-quarter mils thick, but is always thinner than the thickness of the film 90 used to form the walls 16 and 18 of the pouch 10. In general, films of less than about two mils thickness will not provide the necessary toughness, and films of greater than five mils thickness will be difficult to seal on vacuum packaging equipment that is currently available. Thus the film 120 of the neck portion 14 is relatively thin, and the film 90 of the body portion 12 is relatively thick, as compared to one another. Although the preferred construction of the film 120 has been described, various other constructions of the film 120 can be utilized as will be evident to a person skilled in the art, including a single layer film.

The preferred thickness of each layer of the film 120 may vary in terms of a percentage of the total thickness of the film 120 as follows:

| | |
|---|---|
| outer heat sealable layer 132 | 20–35% |
| tie layer 138 | 5–20% |
| intermediate layer 126 | 10–15% |
| core layer 122 | 5–15% |
| intermediate layer 124 | 10–15% |
| tie layer 136 | 5–20% |
| inner heat sealable layer 128 | 20–35% |

As an example, a coextruded multilayer heat sealable barrier film 120 was produced having a total thickness of three and one-quarter mils. The inner heat sealable layer 128 was formed of polyolefin and had a thickness that comprised twenty-five percent of the total thickness of the film 120. The tie layer 136 had a thickness that comprised seven percent of the total thickness of the film 120. The intermediate layer 124 was formed of nylon and had a thickness that comprised thirteen percent of the total thickness of the film 120. The core layer 122 was formed from EVOH and had a thickness that comprised ten percent of the total thickness of the film 120. The intermediate layer 126 was formed from nylon and had a thickness that comprised thirteen percent of the total thickness of the film 120. The tie layer 138 had a thickness that comprised seven percent of the total thickness of the film 120. The outer heat sealable layer 132 was formed of polyolefin and had a thickness comprising twenty-five percent of the total thickness of the film 120. The outer heat sealable layer 132 was formed comprising a LLDPE while the inner heat sealable layer 128 was formed comprising a ULDPE. The tie layers 136 and 138 were formed with an anhydride LLDPE. The nylon that forms the intermediate layers 124 and 126 comprises nylon 6/66. The EVOH core layer 122 comprises Soarnol ET3803 from Soarus.

As shown in FIG. 3, the outer heat sealable layer 132 of the film 120 is heat sealed to the inner heat sealable layer 92 of the film 90 thereby forming a hermetic seal between the body portion 12 and neck portion 14. The film 90 of the body portion 12 and the film 120 of the neck portion 14 may also be adhesively laminated together. The inner heat sealable layer 92 of the film 90 that comprises the wall 16 is heat sealed to the inner heat sealable layer 92 of the film 90 that comprises the wall 18 along the heat seals 32 and 34, and also along the heat seal 42 when two separate sheets of film 90 are used.

In operation, bone-in meat is placed into the chamber 36 of the body portion 12 of the pouch 10 through the mouth 80 and passage 82 of the neck portion 14. The bone-in meat or other product that is to be packaged is covered by the body portion 12 of the pouch 10. The air, and in particular the oxygen, in the chamber 36 of the pouch 10 is evacuated to produce a vacuum package. The first wall 48 and the second wall 50 of the neck portion 14 are then heat sealed together to hermetically seal the passage 82 to maintain the vacuum in the package. When the air is evacuated from the chamber 36 the first wall 16 and second wall 18 of the pouch 10 conform to the shape of the product in the chamber 36. A completely hermetically sealed pouch 10 is thus formed which is air tight. Methods for sealing the neck portion 14 include impulse or resistant heat sealing. The first and second walls 16 and 18 of the body portion 12 and also the first and second walls 48 and 50 of the neck portion 14 are preferably clear such that the packaged product can be visually inspected through the walls of the pouch 10. The pouch 10 may be used in packaging operations other than vacuum packaging. For example, the pouch 10 could be gas flushed and then sealed, or just sealed, with no atmosphere pressure change.

A further embodiment of the multilayer puncture-resistant barrier pouch of the present invention is shown in FIGS. 4 and 5 by the reference numeral 146. FIG. 4 shows the pouch 146 before final forming into a pouch configuration. As shown in FIG. 4, the pouch 146 includes a multilayer heat sealable film 148 formed in the same manner and of the same construction as the heat sealable film 120 illustrated in FIG. 3 and described herein. However, the outer heat sealant layer 132 of the film 148 may be formed from materials other than heat sealable materials if desired. The film 148 is preferably between approximately two and approximately five mils thick The film 148 extends between a first end 150 and a second end 152 and includes first and second side edges 154 and 156 that respectively extend between the first and second ends 150 and 152. The pouch 146 also includes a multilayer puncture-resistant film 160 that is constructed in the same manner as the film 90. However, the inner heat sealant layer 92 of the film 160 may be formed from materials other than heat sealable materials if desired. The film 160 is preferably between approximately one mil and approximately ten mils thick The film 160 extends between a first end 162 and a second end 164 and includes first and second side edges 166 and 168 that respectively extend between the first and second ends 162 and 164. In a preferred embodiment the films 148 and 160 are each non-heat-shrinkable films.

As shown in FIG. 4, the film 160 is generally centered on the film 148 such that the end 162 is spaced inwardly from the end 150 of the film 148 and such that the end 164 of the film 160 is spaced inwardly from the end 152 of the film 148. The edge 166 of the film 160 is generally aligned with the edge 154 of the film 148 and the edge 168 of the film 160 is generally aligned with the edge 156 of the film 148. The inner layer 92 of the film 160 is adhered to the outer layer 132 of the film 148 by methods known in the art to form a laminated sheet including adhesive lamination. The films 148 and 160 may alternatively be extrusion laminated or coextruded.

The laminated films 148 and 160 are folded along a fold line 170 such that the inner heat sealable layer 128 of the film 148 is folded onto itself as shown in FIG. 5. Alternatively, the outer layer 102 of the film 160 may be formed from a heat sealable material and the laminated films 148 and 160 may be folded along the fold line 170 in the opposite direction such that the outer layer 102 of the film 160 is folded onto itself. The folded-over films 148 and 160 form a first wall 180 and a second opposing wall 181. The first wall 180 includes a first sheet 182 formed by the film 160 having a first end 183 that corresponds to the first end 162 of the film 160 and a second end 184 adjacent the fold line 170. The first wall 180 also includes a second sheet 185 formed by the film 148 having a first end 186 that corresponds to the first end 150 of the film 148 and a second end 187 adjacent the fold line 170. The second wall 181 is constructed similar to the first wall 180. The second wall 181 includes a first sheet 188 formed by the film 160 and a second sheet 189 formed by the film 148. The first sheet 188 extends between the second end 164 of the film 160 and an end located adjacent the fold line 170. The second sheet 189 extends between the second end 152 of the film 148 and an end located adjacent the fold line 170. The side edges 154, 156, 166 and 168 of the films 148 and 160 are heat sealed to one another along the outside perimeter forming a hermetic seal along the side edges of the pouch 146. The bottom of the pouch 146 is closed by the fold 170 which can be left as a fold or the opposing walls 180 and 181 at the fold 170 can be heat sealed together. The pouch 146 includes a chamber 172 and an open mouth 174 that provides access to the chamber 172. The end 150 of the film 148 may be offset from the end 152 to provide a lip. As shown in FIG. 5, the pouch 146 includes a relatively thick body portion 176 formed by the film 160 and the portion of the film 148 that is laminated thereto. A relatively thin neck portion 178 is formed by the portions of the film 148 which project outwardly beyond the ends 162 and 164 of the film 160. The opposing walls of the neck portion 178 can be hermetically heat sealed to one another to hermetically seal the chamber 172 and maintain a vacuum package.

FIGS. 6 and 7 show a further modified embodiment of the pouch that is identified with the reference numeral 190. The pouch 190 includes a first sheet of multilayer film 192 and a second sheet of multilayer film 194. The first and second films 192 and 194 are constructed in the same manner as the heat sealable film 120 and each has a thickness of preferably between approximately two mils and approximately five mils. The first film 192 extends between a first end 196 and a second end 198 and includes a first side edge 200 and an opposing second side edge 202 that extend between the first and second ends 196 and 198. The second film 194 extends between a first end 204 and a second end 206. In a preferred embodiment the films 192 and 194 are each non-heat-shrinkable films.

A third sheet of film 208, that is constructed in the same manner as the puncture-resistant film 90, is adhesively laminated to the outer surface of the first film 192 to form a laminated sheet 195. The films 192 and 208 may alternatively be extrusion laminated or coextruded. The third film 208 includes a first end 210 that is spaced inwardly from the first end 196 of the first film 192 and a second end 212 that is aligned with the second end 198 of the first film 192. The third film 208 includes side edges that are aligned with the first and second side edges of the first film 192. A fourth sheet of film 214, which is constructed in the same manner as the puncture-resistant film 90, is adhesively laminated to the outer surface of the second film 194 to form a laminated sheet 209. The films 194 and 214 may alternatively be extrusion laminated or coextruded. The films 208 and 214 each preferably have a thickness of between approximately one mil and approximately ten mils. The fourth film 214 includes a first end 216 that is located inwardly from the first end 204 of the second film 194 and a second end 218 that is aligned with the second end 206 of the second film 194. The fourth film 214 includes side edges that extend between the first and second ends 216 and 218 that are aligned with the side edges of the second film 194. In a preferred embodiment the films 208 and 214 are each non-heat-shrinkable films.

The laminated sheet 195 overlies the laminated sheet 209 such that the first film 192 is facing the second film 194 as shown in FIG. 7. Alternatively, the outer layer 102 of the films 208 and 214 may be formed from a heat sealable material and the laminated sheet 195 may overlie the laminated sheet 209 such that the third film 208 is facing the fourth film 214. The second ends 198, 206, 212 and 218 of the films 192, 194, 208 and 214 are aligned with one another as are the side edges of the films. If desired, the ends 212 and 218 and the side edges of the third and fourth sheets of films 208 and 214 may extend beyond the ends 198 and 206 and the side edges of the first and second sheets of film 192 and 194. The first end 204 of the second film 194 preferably extends beyond the first end 196 of the first film 192 to form a lip. If desired the lip can be eliminated. A hermetic heat seal is formed between the first film 192 and the second film 194 along the second ends 198 and 206. A hermetic heat seal 222 is formed between the first and second films 192 and 194 along their first side edges 200 and a hermetic heat seal 224 is formed between the first and second films 192 and 194 along their second side edges 202.

As shown in FIG. 7, the pouch 190 includes a relatively thick body portion 226 that is formed by the third and fourth films 208 and 214 and the portions of the first and second films 192 and 194 that are laminated to the third and fourth films 208 and 214. The pouch 190 also includes a relatively thin neck portion 228 formed by the portions of the first film 192 and second film 194 that project outwardly beyond the first ends 210 and 216 of the third and fourth films 208 and 214. The neck portion 228 includes an open mouth that forms a passage to a chamber within the body portion 226. The opposing walls of the neck portion 228 can be hermetically sealed to one another to hermetically seal the chamber within the pouch 190. If desired, the pouch 190 can be formed without the fourth sheet of film 214.

FIG. 8 shows another embodiment of the pouch identified with the reference numeral 250. The pouch 250 includes a body portion 252 and a neck portion 254 extending outwardly from the body portion 252. The body portion 252 includes a first wall 256 and an opposing second wall 258. The neck portion 254 includes a first wall 260 and an opposing second wall 262. The wall 256 is connected to the wall 260 by a tapered transition portion 264 and the wall 258 is connected to the wall 262 by a tapered transition portion 268. As shown in FIG. 8, the walls 256 and 258 of the body portion 252 are thicker than the walls 260 and 262 of the neck portion 254. The transition portions 264 and 268 vary in thickness from the thickness of the walls 260 and 262 to the thickness of the walls 256 and 258.

The side edges of the body portion 252 and the neck portion 254 are heat sealed together to form hermetic seals. The bottom end of the pouch 250 is closed by either a fold 270, as shown in FIG. 8, or by the fold 270 and a heat seal that is formed along the fold 270, or by heat sealing a separate wall 256 to a separate wall 258 along the bottom of the pouch 250. The pouch 250 includes a chamber 271 located within the body portion 252. The neck portion 254 includes a mouth 272 and a passage 274 that extends between the mouth 272 and the chamber 271.

The pouch 250, including the body portion 252 and the neck portion 254, is preferably formed as a single sheet of extruded film 280 having the first wall 260 formed with a first thickness at one end, the walls 256 and 258 in the center formed with a second and larger thickness, and the second wall 262 at the opposite end formed with a thickness equal to the thickness of the wall 260. The film 280 may include an inner heat seal layer 282, an outer layer 284 that is preferably heat resistant, and a core barrier layer 286 that forms a barrier to oxygen. The core layer 286 is located between the inner layer 282 and the outer layer 284. The film 280 may include additional or fewer layers if desired, and may be formed from a single layer. In a preferred embodiment the film 280 is a non-heat-shrinkable film.

The thick walls 256 and 258 of the body portion 252 resist puncturing or tearing by a product contained in the chamber 271. The relatively thin walls 260 and 262 of the neck portion 254 can be heat sealed together to hermetically seal the passage 274 and thereby hermetically seal the product within the chamber 271.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A puncture resistant barrier pouch for the packaging of bone-in meat and other products, said pouch including:

a body portion including a first wall and a second wall overlying said first wall, said first wall connected to said second wall about a portion of its periphery, a chamber formed between said first wall and said second wall adapted to receive and contain the product, said first wall and said second wall each being formed from a puncture resistant film, a mouth formed between said first wall and said second wall that is in communication with said chamber, said first wall and said second wall each having a respective inner surface and a respective outer surface, said first wall having a first thickness extending between said inner surface and said outer surface of said first wall, said second wall having a second thickness extending between said inner surface and said outer surface of said second wall, said puncture resistant film including a heat sealable first layer, a second layer, and a core layer disposed between said first and second layers, said core layer being formed from an oxygen barrier material; and a neck portion including a third wall, a fourth wall overlying said third wall, and a product passage formed between said third wall and said fourth wall, said third wall and said fourth wall each being formed from a heat sealable film, said neck portion being attached to said body portion such that said product passage is in communication with said mouth of said body portion and with said chamber of said body portion, said third wall and said fourth wall each having a respective inner surface and a respective outer surface, said third wall having a third thickness extending between said inner surface and said outer surface of said third wall, said fourth wall having a fourth thickness extending between said inner surface and said outer surface of said fourth wall, said third and fourth thicknesses of said third and fourth walls of said neck portion being respectively thinner than each of said first and second thicknesses of said first and second walls of said body portion;

whereby, said relatively thin third wall and fourth wall of said neck portion may be easily heat sealed together thereby sealing closed said product passage of said neck portion and said chamber of said body portion, and said relatively thick first and second walls of said body portion provide increased resistance to puncturing of said body portion by the product.

2. The puncture resistant barrier pouch of claim 1 wherein said third wall and said fourth wall are respectively formed from a non-heat-shrinkable film.

3. The puncture resistant barrier pouch of claim 2 wherein said first wall and said second wall are respectively formed from a non-heat-shrinkable film.

4. The puncture resistant barrier pouch of claim 1 wherein said neck portion is heat sealed to said body portion, said third wall of said neck portion being heat sealed to said first wall of said body portion and said fourth wall of said neck portion being heat sealed to said second wall of said body portion.

5. The puncture resistant barrier pouch of claim 4 wherein said outer surface of said third wall of said neck portion is heat sealed to said inner surface of said first wall of said body portion, and said outer surface of said fourth wall of said neck portion is heat sealed to said inner surface of said second wall of said body portion.

6. The puncture resistant barrier pouch of claim 1 wherein said first wall and said second wall of said body portion are formed from a single sheet of puncture resistant film that is folded over upon itself to form a fold at one end.

7. The puncture resistant barrier pouch of claim I wherein said heat sealable first layer of said puncture resistant film forms said inner surface of said first wall and said inner surface of said second wall of said body portion, and said second layer of said puncture resistant film forms said outer surface of said first wall and said outer surface of said second wall of said body portion.

8. The puncture resistant barrier pouch of claim 1 wherein said heat sealable first layer of said puncture resistant film is formed from a heat sealable polymeric material selected from the group consisting of very low density polyethylene, ultra low density polyethylene, polyolefin resins made with metallocene single-site catalysts, and ethylene vinyl acetate copolymers.

9. The puncture resistant barrier pouch of claim 1 wherein said oxygen barrier material comprises an ethylene vinyl alcohol copolymer.

10. The puncture resistant barrier pouch of claim 1 including a first intermediate layer bonded to a first surface of said core layer and a second intermediate layer bonded to a second surface of said core layer.

11. The puncture resistant barrier pouch of claim 10 wherein said first and second intermediate layers are each formed from a polyamide.

12. The puncture resistant barrier pouch of claim 1 wherein said second layer of said puncture resistant film is formed from a polyamide or a polyolefin.

13. The puncture resistant barrier pouch of claim 1 wherein said first thickness of said first wall and said second thickness of said second wall of said body portion are each between approximately three mils and twelve mils.

14. The puncture resistant barrier pouch of claim 1 wherein said heat sealable film of said neck portion comprises an inner heat sealable layer, a core layer, and an outer heat sealable layer, said inner heat sealable layer forming said inner surface of said third wall and said inner surface of said fourth wall of said neck portion, said outer heat sealable layer forming said outer surface of said third wall and said outer surface of said fourth wall of said neck portion.

15. The puncture resistant barrier pouch of claim 14 wherein said inner heat sealable layer and said outer heat sealable layer of said heat sealable film is formed from a polymeric material selected from the group consisting of ethylene alpha-olefin copolymer, very low density polyethylene, polyolefin resins made with metallocene single-site catalysts, and linear low density polyethylene.

16. The puncture resistant barrier pouch of claim 14 wherein said core layer of said heat sealable film of said neck portion is formed from an oxygen barrier material.

17. The puncture resistant barrier pouch of claim 16 wherein said oxygen barrier material of said heat sealable film of said neck portion comprises an ethylene vinyl alcohol copolymer.

18. The puncture resistant barrier pouch of claim 15 including a first intermediate layer bonded to a first surface of said core layer and a second intermediate layer bonded to a second surface of said core layer.

19. The puncture resistant barrier pouch of claim 18 wherein said first and second intermediate layers are each formed from a polyamide.

20. The puncture resistant barrier pouch of claim 15 wherein said third thickness of said third wall and said fourth thickness of said fourth wall of said neck portion are each between approximately two mils and five mils.

21. A puncture resistant barrier pouch for the packaging of bone-in meat and other products, said pouch including:

a first wall including a first sheet formed from a puncture resistant film, said first sheet having a first end and a second end, and a second sheet formed from a heat sealable film, said second sheet having a first end and a second end, said first sheet overlying and attached to said second sheet, said first end of said first sheet being spaced inwardly apart front said first end of said second sheet, said puncture resistant film of said first sheet including a heat sealable first layer, a second layer, and a core layer disposed between said first layer and said second layer, said core layer being formed from an oxygen barrier material;

a second wall including a third sheet formed from a heat sealable film, said third sheet having a first end and a second end, said second wall being attached to said first wall about a portion of its periphery thereby forming a chamber between said first wall and said second wall adapted to receive the product and forming a mouth between said second sheet and said third sheet in communication with said chamber;

whereby said first end of said second sheet may be heat sealed to said first end of said third sheet to seal said chanber, said puncture resistant film of said first sheet providing increased resistance to puncturing of said pouch by the product.

22. The puncture resistant barrier pouch of claim 21 wherein said second end of said second sheet is heat sealed to said second end of said third sheet.

23. The puncture resistant barrier pouch of claim 21 wherein said second end of said second sheet is integrally attached to said second end of said third sheet.

24. The puncture resistant barrier pouch of claim 21 wherein said first sheet, said second sheet and said third sheet are respectively formed from a non-heat-shrinkable film.

25. The puncture resistant barrier pouch of claim 21 wherein said second wall includes a fourth sheet formed from a puncture resistant film having a first end and a second end, said fourth sheet overlying and attached to said third sheet, said first end of said fourth sheet being spaced inwardly from said first end of said third sheet.

26. The puncture resistant barrier pouch of claim 25 wherein said second end of said first sheet is integrally attached to said second end of said fourth sheet.

27. The puncture resistant barrier pouch of claim 25 wherein said second and third sheets each have a thickness that is thinner than the thickness of each of said first and fourth sheets.

28. The puncture resistant barrier pouch of claim 25 wherein said second and third sheets are each approximately two mils to five mils thick, and said first and fourth sheets are each approximately one mil to ten mils thick.

29. The puncture resistant barrier pouch of claim 25 wherein said fourth sheet is formed from a non-heat-shrinkable film.

30. A puncture resistant barrier pouch for the packaging of bone-in meat and other products, said pouch including:

a body portion including a first wall having a first end and a second end, a second wall having a first end and a second end, said second wall overlying said first wall, said first wall connected to said second wall about a portion of its periphery, a chamber formed between said first wall and said second wall adapted to receive and contain the product, said first wall and said second wall each being formed from a puncture resistant film; and a neck portion including a third wall having a first end and a second end, a fourth wall having a first end and a second end, said fourth wall overlying said third wall, and a product passage formed between said third wall and said fourth wall in communication with said chamber of said body portion, said third wall and said fourth wall each being formed from a heat sealable film, said third wall of said neck portion being attached to said first wall of said body portion such that said first end of said third wall is located outwardly from said body portion and said second end of said third wall is attached to said first wall of said body portion, said heat sealable film of said third wall terminating at said second end of said third wall at a location proximate said first end of said first wall, and said fourth wall of said neck portion being attached to said second wall of said body portion such that said first end of said fourth wall is located outwardly from said body portion and said second end of said fourth wall is attached to said second wall of said body portion, said heat sealable film of said fourth wall terminating at said second end of said fourth wall at a location proximate to said first end of said second wall;

whereby, said third wall and fourth wall of said neck portion may be easily heat sealed together thereby sealing closed said product passage of said neck portion and said chamber of said body portion, and said first and second walls of said body portion provide increased resistance to puncturing of said body portion by the product.

31. The puncture resistant barrier pouch of claim 30 wherein said neck portion is heat sealed to said body portion, said third wall of said neck portion being heat sealed to said first wall of said body portion and said fourth wall of said neck portion being heat sealed to said second wall of said body portion.

32. The puncture resistant barrier pouch of claim 30 wherein said first wall and said second wall of said body portion are formed from a single sheet of puncture resistant film that is folded over upon itself to form a fold at one end.

33. The puncture resistant barrier pouch of claim 30 wherein said third wall of said neck portion is attached to an inner surface of said first wall of said body portion.

34. The puncture resistant barrier pouch of claim 30 wherein said first end of said third wall of said neck portion is spaced apart from said first wall of said body portion.

35. A puncture resistant barrier pouch for the packaging of bone-in meat and other products, said pouch including:

a body portion including a first wall and a second wall overlying said first wall, said first wall connected to said second wall about a portion of its periphery, a chamber formed between. said first wall and said second wall adapted to receive and contain the product, said first wall and said second wall each being formed from a puncture resistant film, a mouth formed between said first wall and said second wall that is in communication with said chamber, said first wall and said second wall each having a respective inner surface and a respective outer surface, said first wall having a first thickness extending between said inner surface and said outer surface of said first wall, said second wall having a second thickness extending between said inner surface and said outer surface of said second wall, said puncture resistant film including a heat sealable first layer forming said inner surfaces of said first and second walls, a second layer forming said outer surfaces of said first and second walls, and a core layer disposed between said first and second layers; and a neck portion including a third wall, a fourth wall overlying said third wall, and a product passage formed between said third wall and said fourth wall, said third wall and said fourth wall each being formed from a heat sealable film, said neck portion being attached to said body portion such that said product passage is in communication with said mouth of said body portion and with said chamber of said body portion, said third wall and said fourth wall each having a respective inner surface and a respective outer surface, said third wall having a third thickness extending between said inner surface and said outer surface of said third wall, said fourth wall having a fourth thickness extending between said inner surface and said outer surface of said fourth wall, said third and fourth thicknesses of said third and fourth walls of said neck portion being respectively thinner than each of said first and second thicknesses of said first and second walls of said body portion;

whereby, said relatively thin third wall and fourth wall of said neck portion may be easily heat sealed together thereby sealing closed said product passage of said neck portion and said chamber of said body portion, and said relatively thick first and second walls of said body portion provide increased resistance to puncturing of said body portion by the product.

36. A puncture resistant barrier pouch for the packaging of bone-in meat and other products, said pouch including:

a body portion including a first wall and a second wall overlying said first wall, said first wall connected to said second wall about a portion of its periphery, a chamber formed between said first wall and said second wall adapted to receive and contain the product, said first wall and said second wall each being formed from a puncture resistant film, a mouth formed between said first wall and said second wall that is in communication with said chamber, said first wall and said second wall each having a respective inner surface and a respective outer surface, said first wall having a first thickness extending between said inner surface and said outer surface of said first wall, said second wall having a second thickness extending between said inner surface and said outer surface of said second wall, said puncture resistant film including a heat sealable first layer, a second layer, and a core layer disposed between said first and second layers; and a neck portion including a third wall, a fourth wall overlying said third wall, and a product passage formed between said third wall and said fourth wall, said third wall and said fourth wall each being formed from a heat sealable film, said neck portion being attached to said body portion such that said product passage is in communication with said mouth of said body portion and with said chamber of said body portion, said third wall and said fourth wall each having a respective inner surface and a respective outer surface, said third wall having a third thickness extending between said inner surface and said outer surface of said third wall, said fourth wall having a fourth thickness extending between said inner surface and said outer surface of said fourth wall, said third and fourth thicknesses of said third and fourth walls of said neck portion being respectively thinner than each of said first and second thicknesses of said first and second walls of said body portion, said heat sealable film of said neck portion including an inner heat sealable layer, a core layer, and an outer heat sealable layer, said inner heat sealable layer forming said inner surface of said third wall and said inner surface of said fourth wall of said neck portion, said outer heat sealable layer forming said outer surface of said third wall and said outer surface of said fourth wall of said neck portion;

whereby, said relatively thin third wall and fourth wall of said neck portion may be easily heat sealed together thereby sealing closed said product passage of said neck portion and said chamber of said body portion, and said relatively thick first and second walls of said body portion provide increased resistance to puncturing of said body portion by the product.

* * * * *

UNITED STATES PATENT AND TRADEMARK OFFICE

CERTIFICATE OF CORRECTION

PATENT NO. : 6,015,235

DATED : January 18, 2000

INVENTOR(S) : Amy L. Kraimer, et al.

It is certified that error appears in the above-identified patent and that said Letters Patent is hereby corrected as shown below:

Column 13, line 9, delete "front" and insert --from--.

Column 13, line 25, delete "chanber" and insert --chamber--.

Column 14, line 51, delete ".".

Signed and Sealed this

Twelfth Day of December, 2000

*Attest:*

Q. TODD DICKINSON

*Attesting Officer*

*Director of Patents and Trademarks*